US005388293A

United States Patent [19]

Kistner

[11] Patent Number: 5,388,293

[45] Date of Patent: Feb. 14, 1995

[54] COVER FOR CHAISE LOUNGE CUSHION

[76] Inventor: Janet Z. Kistner, 620 S. Pathfinder Trail, Anaheim, Calif. 92807

[21] Appl. No.: 94,742

[22] Filed: Jul. 22, 1993

[51] Int. Cl.[6] ..... A47G 9/00

[52] U.S. Cl. ..... 5/470; 5/482; 297/229

[58] Field of Search ..... 5/470, 490, 501, 482, 5/448; 297/224, 229

[56] References Cited

U.S. PATENT DOCUMENTS

| | | | |
|---|---|---|---|
| 1,970,820 | 8/1934 | Schoellkopf | 297/229 |
| 2,460,452 | 2/1949 | Hampton | 5/339 |
| 3,241,161 | 3/1966 | Dashosh | 5/490 |
| 4,193,152 | 5/1980 | Seibold | 5/490 |
| 4,780,921 | 11/1988 | Lahn | 5/437 |
| 4,967,428 | 11/1990 | Browder | 5/419 |
| 5,084,928 | 2/1992 | Skillington | 5/490 |
| 5,111,544 | 5/1992 | Graebe | 5/470 |
| 5,203,041 | 4/1993 | Alonso | 5/470 |

*Primary Examiner*—Alexander Grosz
*Attorney, Agent, or Firm*—T. R. Zegree

[57] ABSTRACT

A flexible and stretchable cover for a chaise longue cushion comprises an open top closable by a fastening means for easy insertion and removal of the cushion. A pair of elastic strips attached to the inner surface of the cover in its middle portion allows the sides of the cover to expand thereby forming side walls conforming to the width of a cushion enclosed therein. A flap member projecting from the open top portion of the cover conceals the fastening means, such as a zipper.

13 Claims, 1 Drawing Sheet

COVER FOR CHAISE LOUNGE CUSHION

BACKGROUND OF THE INVENTION

This invention relates to a cover for a chaise longue cushion. More particularly, the invention relates to a novel protective cover for use in enclosing such cushion therein.

As is well known, cushions have been used extensively on chairs to provide a comfortable support for the user's back and legs while resting on an outdoor type chaise longue. However, the surface of cushions of this type becomes soiled in the course of normal use quite frequently by dirty spots, stains and the like to render their appearance unsightly so that a purchase of a new cushion appears to be required or at least highly desirable. In an attempt to protect certain types of cushions, coverings therefor have been described in the patent literature. Thus U.S. Pat. No. 2,460,452 to Hampton describes a removable covering for a prismatic pillow having triangular end and side panels. U.S. Pat. No. 4,193,152 to Seibold discloses a pillow casing folded in the center and provided with a pair of Velcro strips secured at each end thereof. U.S. Pat. No. 4,780,921 to Lahn describes a cover for a therapeutic support cushion having a transversely disposed vertical partition. U.S. Pat. No. 5,084,928 to Skillington discloses a compressible pillowcase having length and width dimensions smaller than the dimensions of a pillow to be placed therein; and U.S. Pat. No. 5,111,544 to Graebe describes a cushion cover having an elastic top panel and a bottom panel formed from a high friction mesh.

While the above-mentioned patents disclose a general concept of covers for specific types of cushions other than those for chaise longues, this invention provides a new concept to a structural form of a cover especially devised for use in conjunction with chaise longue cushions which offers certain advantages not known heretofore.

OBJECTS OF THE INVENTION

In view of the foregoing, it is the primary object of the present invention to provide a novel cover specifically adapted for enclosing a chaise longue cushion.

It is another object of this invention to provide a protective cover characterized by a novel structure for use in combination with a cushion designed for a chaise longue to prevent such cushion from being soiled or deteriorated by the outdoor elements.

A further object of the invention is the provision of a replaceable chaise longue cushion cover having its size and shape conforming to the particular dimensions of a cushion to be enclosed therein.

It is still another object of the invention to provide a unitary cover for a chaise longue cushion of the character described herein which can be manufactured in large quantities at a low cost from readily available materials.

These and other related objects will become more fully apparent to those skilled in the art from the following description considered in conjunction with the accompanying drawings.

BRIEF SUMMARY OF THE INVENTION

In accordance with the present invention, there is provided a unitary, flexible cover for a chaise longue cushion comprising a pair of flat, oppositely disposed, elongated panels of a generally rectangular shape secured together by stitching along the two long sides and the short bottom portion thereof thereby forming a structure having an open top portion which is completely closable by a fastening means, said open top portion being adapted for insertion and removal of the cushion therefrom. The cover is expansible in the peripheral side portions such as to form a pair of oppositely disposed side walls with the cushion inserted therein.

BRIEF DESCRIPTION OF THE DRAWINGS

In the accompanying drawings wherein like numerals designate corresponding elements throughout the views thereof.

DETAILED DESCRIPTION OF THE INVENTION

Figure 1:
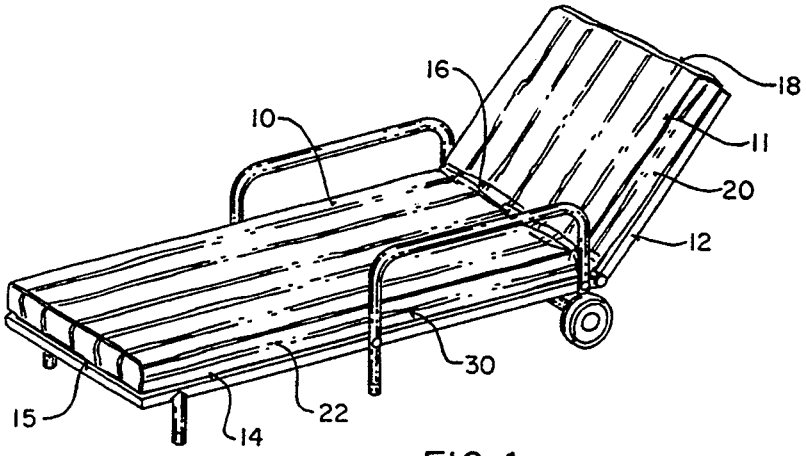
FIG. 1 is a perspective view of a conventional chaise longue with a cushion therefor enclosed in the cover of this invention.

Referring now to the drawings, a flexible, foldable and stretchable cover 10 enclosing completely a cushion disposed on chaise longue 12 is illustrated in FIG. 1. Cover 10 comprises an elongated front panel 11 and a rear panel 32 of generally the same size, both panels being of substantially rectangular shape and secured to each other by stitching along their side edges 14 and bottom edge 15, thereby forming two coextensive flat panels, the inner surfaces of which are adhering to each other.

Figure 4:
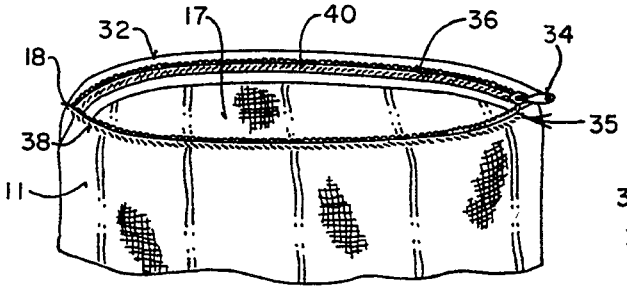
FIG. 4 is a fragmentary perspective view of the top portion of the cover in its open position showing the zipper device in detail.

As shown in FIG. 4, cover 10 includes an open top 17 and a transverse middle portion 16 which delineates back portion 20 and front portion 22 thereof to conform the cover tightly to the contour of the cushion when it is placed on chaise longue 12 in the reclining position.

Open top portion comprises top edge portion 18 which is foldable inwardly. Open top portion 17 is closable by a suitable fastening means 35, preferably a zipper device having a traveling member 34 slidable along interlocking tabs provided on tape 36 affixed by stitching 40 to the inner surface of cover 10 adjacent to the top edge portion 18 thereof and extending throughout the width of cover 10 close to the edge of its open top portion 17. Another stitching 38 extends around the width of cover 10 for affixing the opposite portion of tape 36. Other types of fastening means for closing top portion 17 which may be used are "Velcro" adhesive tape which may be attached by stitching around the edge portion of open top 17, as well as standard snaps or buttons.

Figure 5:
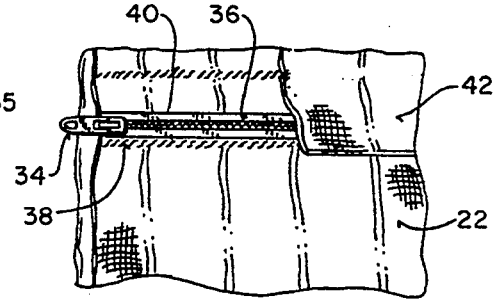
FIG. 5 is a fragmentary view of the top portion of the cover with a portion broken away illustrating the zipper device and the folded lap covering the continuation of the zipper device.

Open top portion 17 further includes a lap member 42, a portion of which is shown in FIG. 5. Lap member 42 extends around the width of cover 10 from the edge of rear panel 32, being foldable downwardly over the opposite top portion of front panel 11 thereby covering fastening means 35, the width of lap member varying from ½ in. to about 1 in., preferably ¾ in.

Although the overall dimensions of cover 10 may vary to some extent, its length and width are adapted to surround a conventional chaise longue cushion completely in a snug fit.

Figure 6:
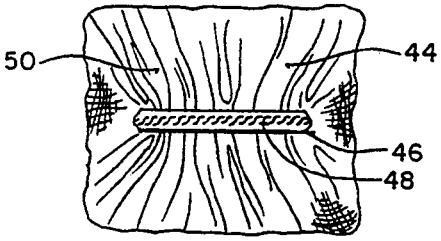
FIG. 6 is a fragmentary view of a small segment of the inner surface of a panel in its middle portion showing an elastic strip affixed thereto forming a gather in the panel.

Cover 10 is further provided with a pair of narrow elastic strips 46 from about 2 in. to 3 in. long and from about ½ in. to ¾ in. wide which are attached transversely opposite each other by stitching 48 to inner surface 44 of panels 11 and 32 at the generally middle portion 16 thereof. While the front panel 11 and rear panel 32 are stitched together, as described hereinabove, so that their inner surfaces are in contact with each other when cover 10 is empty, elastic strips 46 are disposed to form a gather 50 in the fabric material of the panels, as illustrated in FIG. 6 so that both longitudinal side edges of cover 10 are allowed to be stretched sufficiently over a relatively narrow area corresponding substantially to the thickness of a cushion when inserted into cover 10, thereby forming opposite side walls 30 in cover 10 enclosing a cushion. Although the form of gather 50 may vary somewhat depending on the size of elastic strips 46, its ration of about 2:1 is generally satisfactory to insure a snug accomodation of a cushion therein.

Figure 2:
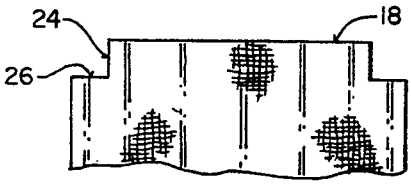
FIG. 2 is a fragmentary plan view of the top portion of a panel showing an indentation in each corner thereof forming a notch.
Figure 3:
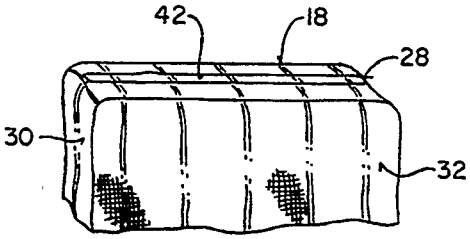
FIG. 3 is a fragmentary perspective view of the upper portion of the cover after the notches have been assembled to form closed rounded corners.

A further feature of cover 10 is the provision of indented four corners in each of the panels 11 and 32 before they are assembled by stitching, thereby forming notches 24, as shown in FIG. 2 in a manner to form a substantially a right angle. The free edge portions 26 of notches 24 are from about 1 in. to 4 in. long, preferably about 2½ in., and are brought together by stitching on the inner surface of cover 10 to produce closed rounded corners 28, as shown in FIG. 3, which are adapted to fit the corners of a cushion after its insertion into the cover.

The two panels forming the cover of the present invention are cut in equal size preferably from the same sturdy fabric material having substantially uniform thickness and made of natural fibers, such as cotton, linen and the like or man-made fibers, such as Nylon and Dacron, or from mixtures thereof. Moreover, cover 10 is made of a washable fabric which may be treated with certain known compounds imparting thereto a waterproof quality and weather- and stain resistance.

It will be apparent from the foregoing description of my invention in its preferred embodiment that I have devised a novel, hollow, unitary cover adapted specifically for use in combination with a chaise longue cushion, the cover being particularly useful in protecting the cushion from being soiled, stained, mildewed or otherwise damaged during its outdoor exposure by the sap of the trees, animal droppings and other impurities.

Due to the specific arrangement of the top portion of the cover including a lap member overlaying the fastening means and a pair of elastic strips attached to the middle portion of the inner surface of each panel, the cover conceals the fastening means and offers flexibility in stretching its originally flat peripheral portions, when empty, to a pair of side walls conforming to the thickness of a cushion when inserted therein. Due to simplicity of its construction, the cushion may easily be removed through the open portion of the cover to be washed, if necessary, and replaced in its clean condition, thereby avoiding a substantial expense of buying a new chaise longue cushion. Furthermore, the cushion may be manufactured inexpensively in a large volume from readily available materials.

It will be understood that various modifications and variations in the form or in the constructional details of my invention, as described herein for the specific use in conjunction with a chaise longue cushion, are possible without departing from the spirit thereof or the scope of the claims which follow.

I claim:

1. A unitary, flexible cover for a chaise longue cushion comprising a pair of opposite elongated panels of generally rectangular shape secured together along the side and bottom portions thereof thereby forming a flat structure and having an open top portion closable by a fastening means, said open top portion being adapted for insertion and removal of said cushion, said cover being expansible such as to form a pair of opposite side walls with said cushion inserted therein, said cover including a pair of short elastic strips affixed transversely opposite each other to an inner surface of said panels at a generally middle portion thereof.

2. The cover of claim 1 wherein said panels are formed of a sturdy fabric material.

3. The cover of claim 2 wherein said fabric material comprises natural or man-made fibers.

4. The cover of claim 2 wherein said fabric material is waterproof, wheather-resistant, stain-resistant and washable.

5. The cover of claim 1 wherein said open top portion of one panel includes a flap member foldable downwardly over the opposite top portion of the other panel.

6. The cover of claim 5 wherein said fastening means exteds transversely adjacent to the edge of said top portion and comprises a zipper device extending throughout the width of said cover.

7. The cover of claim 1 wherein said panels are secured to each other by stitching.

8. The cover of claim 1 wherein dimensions thereof are adapted to surround completely said cushion in a snug fit.

9. The cover of claim 1 wherein said elastic strips are disposed to form a gather in said middle portion of said panels.

10. The cover of claim 9 wherein said elastic strips are disposed to form a gather in said fabric material in a ratio of about 2:1.

11. The cover of claim 1 wherein each corner of said panels is indented before assembling said panels to form a notch, the free edge portions of said notch being fastened together to produce rounded corners in said cover.

12. The cover of claim 11 wherein said notch is indented to form a substantially right angle.

13. The cover of claim 1, further including a chaise longue cushion removably enclosed therein.

* * * * *